US010924857B2

(12) United States Patent
Xu et al.

(10) Patent No.: US 10,924,857 B2
(45) Date of Patent: Feb. 16, 2021

(54) PORTABLE EARPHONE DEVICE

(71) Applicant: GOERTEK. INC, Weifang (CN)

(72) Inventors: Jiangtao Xu, Weifang (CN); Shoubiao Deng, Weifang (CN); Tao Fan, Weifang (CN)

(73) Assignee: GOERTEK. INC, Shandong (CN)

( * ) Notice: Subject to any disclaimer, the term of this patent is extended or adjusted under 35 U.S.C. 154(b) by 0 days.

(21) Appl. No.: 16/477,250

(22) PCT Filed: Jan. 20, 2017

(86) PCT No.: PCT/CN2017/071888
§ 371 (c)(1),
(2) Date: Jul. 11, 2019

(87) PCT Pub. No.: WO2018/133025
PCT Pub. Date: Jul. 26, 2018

(65) Prior Publication Data

US 2019/0364364 A1 Nov. 28, 2019

(51) Int. Cl.
*H04R 5/033* (2006.01)
*H04R 1/10* (2006.01)

(52) U.S. Cl.
CPC ..... *H04R 5/0335* (2013.01); *H04R 1/1016* (2013.01); *H04R 1/1025* (2013.01); *H04R 1/1066* (2013.01); *H04R 2420/07* (2013.01)

(58) Field of Classification Search
CPC ..... H04R 5/0335; H04R 2420/07; H04R 1/1025; H04R 1/1016
See application file for complete search history.

(56) References Cited

U.S. PATENT DOCUMENTS 6,091,832 A * 7/2000 Shurman ..... G02C 11/06 2/422
2009/0274335 A1 11/2009 Cheung et al.
2016/0098138 A1* 4/2016 Park ..... G06F 1/163 345/173

FOREIGN PATENT DOCUMENTS

CN 101278542 A 10/2008
CN 201408315 Y 2/2010
CN 101788750 A 7/2010
CN 101825832 A 9/2010
CN 101963747 A 2/2011
CN 102736385 A 10/2012
CN 104010241 A 8/2014
(Continued)

*Primary Examiner* — Sunita Joshi
(74) *Attorney, Agent, or Firm* — Ajay A. Jagitani; Miles & Stockbridge P.C.

(57) ABSTRACT

Disclosed is a portable earphone device. The device comprises: a neckline earphone, comprising a voice module and a first wireless communication module communicationally connected to the voice module; and a neckband, comprising a second wireless communication module, a network connection module, and a processor, both the second wireless communication module and the network connection module being communicationally connected to the processor; the first wireless communication module being communicationally connected to the second wireless communication module; the neckline earphone being detachably accommodated in the neckband to constitute a neckband earphone. The device can be individually used as a neckline earphone and can be used as a neckband earphone in an accommodation state.

9 Claims, 2 Drawing Sheets

(56) References Cited

FOREIGN PATENT DOCUMENTS

| | | | |
|---|---|---|---|
| CN | 204180243 | U | 2/2015 |
| CN | 204697243 | U | 10/2015 |
| EP | 2770704 | A1 | 8/2013 |
| WO | 2007/039281 | A1 | 4/2007 |

* cited by examiner

PORTABLE EARPHONE DEVICE

CROSS-REFERENCE TO RELATED APPLICATIONS

This application is a National Stage of International Application No. PCT/CN2017/071888 filed on Jan. 20, 2017 which is hereby incorporated by reference in its entirety.

TECHNICAL FIELD

The present disclosure relates to the technical field of earphone, and in particular, to a portable earphone device.

BACKGROUND

Neckline-type earphones and neckband-type earphones enable wireless transmission between sound sources and the earphones, and support stereo playback, ANC (Active Noise Control) noise reduction and other technologies. These earphones meet user's requirements for music and calls. The appearance of the neckline-type earphones focuses on a sporty style and is not suitable for some business or leisure occasions.

In addition, as the neckline-type earphones are restricted by ear shell space and wearing comfort, current designs of the neckline-type earphones are unable to meet expansion requirements for more functional modules.

Moreover, the neckline-type earphones each communicate with a mobile phone and are dependent on the function of the mobile phone, and thereby cannot be used independently.

However, for users who like outdoor sports such as running, the neckband-type earphones have an unstable center of gravity when they are worn and the experience is not good.

In addition, a contact area of a neckband-type earphone with a user is relatively large, and especially in the case of a direct contact with the skin the user can strongly feel the presence of foreign material.

The above-mentioned two types of earphones can not satisfy the user's demand for use in various scenarios at the same time, and electronic products that combine the functions of both the neckline-type earphones and the neckband-type earphones have not yet appeared.

SUMMARY

One object of the present disclosure is to provide a new technical solution for a portable earphone device.

According to a first aspect of the present disclosure, there is provided a portable earphone device. The device comprises: a neckline-type earphone, comprising a voice module and a first wireless communication module communicationally connected to the voice module; and a neckband, comprising a second wireless communication module, a network connection module and a processor, both the second wireless communication module and the network connection module being communicationally connected to the processor; the first wireless communication module being communicationally connected to the second wireless communication module, and the neckline-type earphone being detachably accommodated in the neckband to constitute a neckband-type earphone.

Optionally, the neckband further comprises a power module for supplying power to the second wireless communication module, the network connection module and the processor.

Optionally, the neckband is arc-shaped, a first accommodating groove for accommodating an earphone body is provided at each of both ends of the neckband, and the neckband is also provided with a second accommodating groove for accommodating a wire.

Optionally, the wire is magnetically attracted in the second accommodating groove.

Optionally, the portable earphone device further comprises a wire controller disposed on the wire, and the neckband is further provided with a third accommodating groove for accommodating the wire controller.

Optionally, the wire controller comprises a contact for charging the neckline-type earphone, a charging terminal for electrically connecting to the contact being disposed within the third accommodating groove, the charging terminal being electrically connected to the power module.

Optionally, a sounding device is further provided on the neckband, the sounding device being communicationally connected to the processor.

Optionally, a storage device is further provided on the neckband, the storage device being communicationally connected to the processor.

Optionally, the first wireless communication module and the second wireless communication module are a Bluetooth module or an infrared module.

Optionally, the network connection module is a WIFI module, a 2G communication module, a 3G communication module, a 4G communication module or a 5G communication module.

The inventors of the present disclosure have found that in the prior art, the neckline-type earphone and the neckband-type earphone cannot satisfy the user's demand for use in various scenarios at the same time, and electronic products that combine the functions of both the neckline-type earphone and the neckband-type earphone have not yet appeared. Therefore, the technical object to be achieved or the technical problem to be solved by the present disclosure is never thought of or expected by a person skilled in the art, so the present disclosure provides a new technical solution.

In the portable earphone device provided by the present disclosure, the neckline-type earphone can be accommodated in the neckband and used as the neckband-type earphone.

In addition, the device has a simple structure and is convenient to carry.

Moreover, the portable earphone device can be used as an AI (artificial intelligence) entrance, wherein the neckband has a larger space for expansion, and wherein more functions can be realized by providing a health management module, a navigation module, a shopping guide module and the like in the neckband.

In addition, when the user is doing sports, such as running, the neckline-type earphone can be removed from the neckband for use as an individual earphone.

In addition, the device can be switched between the neckline-type earphone and the neckband-type earphone, which satisfies the user's wearing requirements in various scenarios and improves the user experience.

Further features of the present disclosure and advantages thereof will become apparent from the following detailed description of exemplary embodiments according to the present disclosure with reference to the attached drawings.

BRIEF DESCRIPTION OF THE DRAWINGS

The accompanying drawings, which are incorporated in and constitute a part of the specification, illustrate embodiments of the disclosure and, together with the description thereof, serve to explain the principles of the disclosure.

DESCRIPTION OF THE REFERENCE NUMERALS

Figure 1:
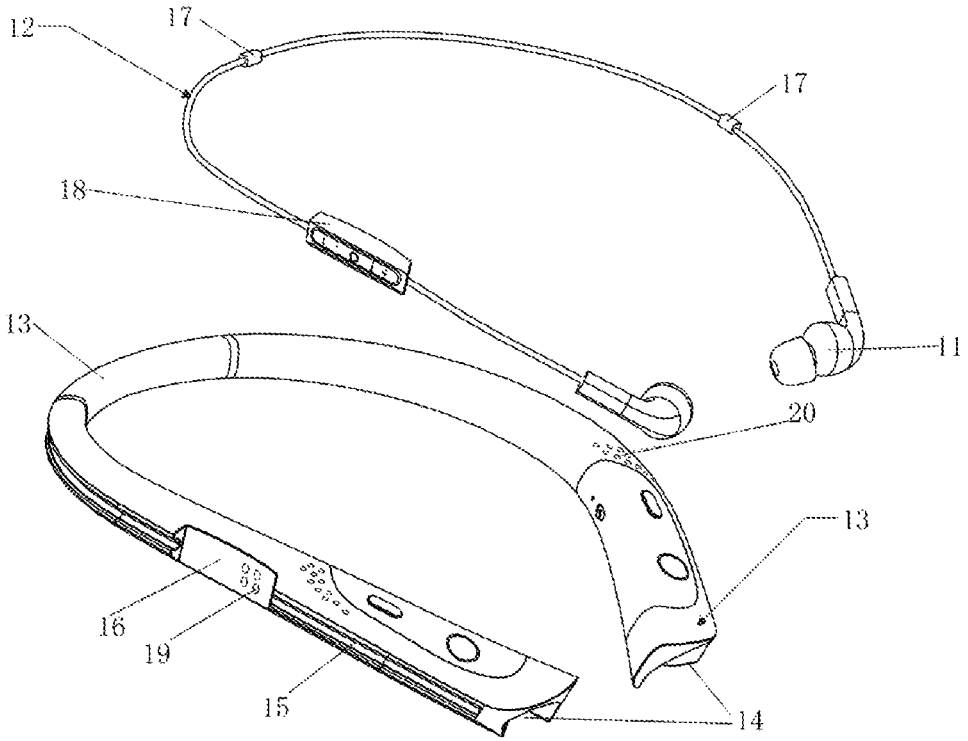
FIG. 1 shows a schematic structural view of a portable earphone device in a separated state according to one embodiment of the present disclosure.

11: earphone body; 12: wire; 13: neckband; 14: first accommodating groove; 15: second accommodating groove; 16: third accommodating groove; 17: magnetic element; 18: wire controller; 19: charging terminal; 20: loudspeaker.

DETAILED DESCRIPTION

Various exemplary embodiments of the present disclosure will now be described in detail with reference to the drawings. It should be noted that the relative arrangement of the components and steps, the numerical expressions, and numerical values set forth in these embodiments do not limit the scope of the present disclosure unless it is specifically stated otherwise.

The following description of at least one exemplary embodiment is merely illustrative in nature and is in no way intended to limit the disclosure, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

According to the embodiments of the present disclosure, there is provided a portable earphone device. The device comprises a neckline-type earphone and a neckband 13. The neckline-type earphone comprises a voice module and a first wireless communication module communicationally connected to the voice module. The neckband 13 comprises a second wireless communication module, a network connection module and a processor. Both the second wireless communication module and the network connection module are communicationally connected to the processor. The first wireless communication module is communicationally connected to the second wireless communication module. The neckline-type earphone is detachably accommodated in the neckband 13 to constitute a neckband-type earphone. For example, the neckline-type earphone comprises an earphone body 11 comprising a left earphone portion and a right earphone portion and a wire 12 for connecting the two earphone portions. At least one of the left earphone portion and the right earphone portion comprises a voice module and a first wireless communication module.

In the portable earphone device provided by the present disclosure, the neckline-type earphone can be accommodated in the neckband 13 and used as a neckband-type earphone.

In addition, the device has a simple structure and is convenient to carry.

Moreover, the portable earphone device can be used as an AI (Artificial Intelligence) entrance, wherein the neckband 13 has a larger space for expansion, and wherein more functions can be realized by providing a health management module, a navigation module, a shopping guide module and the like in the neckband 13.

In addition, when a user is doing sports, such as running, the neckline-type earphone can be removed from the neckband 13 for use as an individual earphone.

In addition, the device can be switched between the neckline-type earphone and the neckband-type earphone, which satisfies the user's wearing requirements in various scenarios and improves the user experience.

The voice module is used to pick up voice commands or sounds. For example, the voice module comprises any one of a moving-coil microphone, a moving-iron microphone and a MEMS microphone, wherein the MEMS microphone conforms to the development trend of miniaturization and thinning of electronic devices. Further, the voice module includes a noise reduction microphone to improve the quality of the voice commands or sounds picked up. The first wireless communication module is configured to send a voice command or sound acquired by the voice module.

Both the second wireless communication module and the network connection module are communicationally connected to the processor, such as, the communicational connections among them are performed through a PCB board. The first wireless communication module is communicationally connected to the second wireless communication module so as to receive the voice commands or sounds from the wireless earphone. The first wireless communication module and the second wireless communication module may be, but are not limited to, a Bluetooth module or an infrared module.

The earphone body 11 of the portable earphone device can be connected to the Internet through the neckband 13, thereby being able to acquire audio files by using the Internet and to perform remote intelligent controls by using the Internet.

Figure 3:
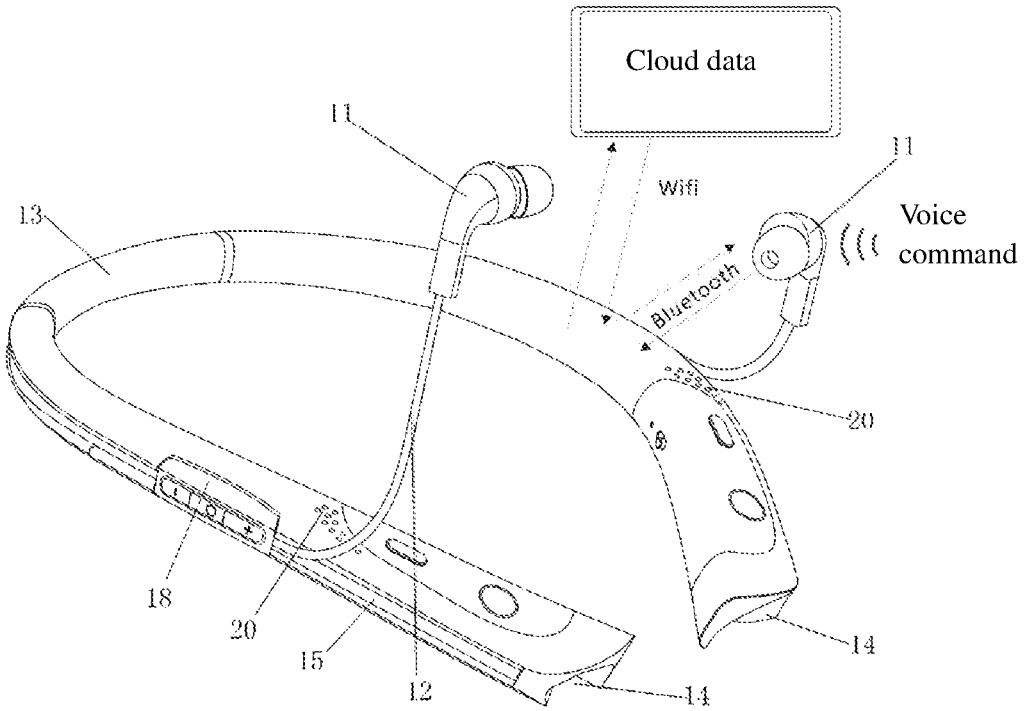
FIG. 3 shows a schematic structural view of the portable earphone device used as a neckband-type earphone according to one embodiment of the present disclosure.

For example, as shown in FIG. 3, the user issues a voice command, such as "Jasmine". The voice module of the neckline-type earphone picks up the voice command and sends it through the first wireless communication module. The second wireless communication module on the neckband 13 receives the voice command and sends it to the processor. The processor identifies the voice command and compares the identified result with a control command pre-stored in the processor (such as, "search music: Jasmine"), and then sends the comparison result to the wireless network for searching through the network connection module. The network connection module may be, but not limited to, a WIFI module, a 2G communication module, a 3G communication module, a 4G communication module or a 5G communication module. For example, the network connection module links to a cloud server and searches for the music "Jasmine" through cloud data. Next, the processor reads the music "Jasmine", and sends it to the first wireless communication module synchronously through the second wireless communication module and then plays it through a loudspeaker 20 built in the earphone body 11, thereby realizing the functions of the voice control, the intelligent search and the play. In addition, the device can also implement a call function through the 2G communication module, the 3G communication module, the 4G communication module or the 5G communication module (such as, by implanting an e-SIM card).

For example, the Bluetooth module adopts a Bluetooth 5.0. The Bluetooth 5.0 has the function of transmitting data over long distances. The portable earphone device can serve as an entrance to the Internet of Things. In the case of the Bluetooth 5.0 built in the neckband 13, the user can control devices within a certain range (for example, within 50 meters) through the portable earphone device to realize the function of the Internet of Things. For example, the user issues a voice command "start the car ahead", and the voice module of the earphone body 11 picks up the command and sends it through the first wireless communication module (such as, the Bluetooth 5.0). The second wireless communication module (such as, the Bluetooth 5.0) on the neckband 13 receives the voice command and sends it to the processor. The processor identifies the voice command and compares the identified result with a control command pre-stored in the processor (such as, "start the car"), and then directly sends the comparison result to the car through the second wireless communication module (for example, the Bluetooth 5.0). The car is provided with a built-in Bluetooth 5.0 to receive control commands, and is started by a built-in processing unit.

For example, control of a smart home or the like can also be realized by the portable earphone device. For example, the user issues a voice command "turn on the air conditioner". The voice module picks up the voice command and sends it through the first wireless communication module to the second wireless communication module. The second wireless communication module receives the voice command and sends it to the processor. The processor identifies the voice command and compares the identified result with a control command pre-stored (such as, "turn on the air conditioner in the home"). The neckband 13 then sends the control command to the Internet via the WIFI module. Then, the control command is transmitted to a smart box in the home through the Internet, and the air conditioner is controlled by the smart box, thus the remote wireless control of turning on the "air conditioner" is finally realized.

In addition, the portable earphone device can realize the networking function and the remote control function regardless of whether it is in a stored state or in a separated state.

Figure 2:
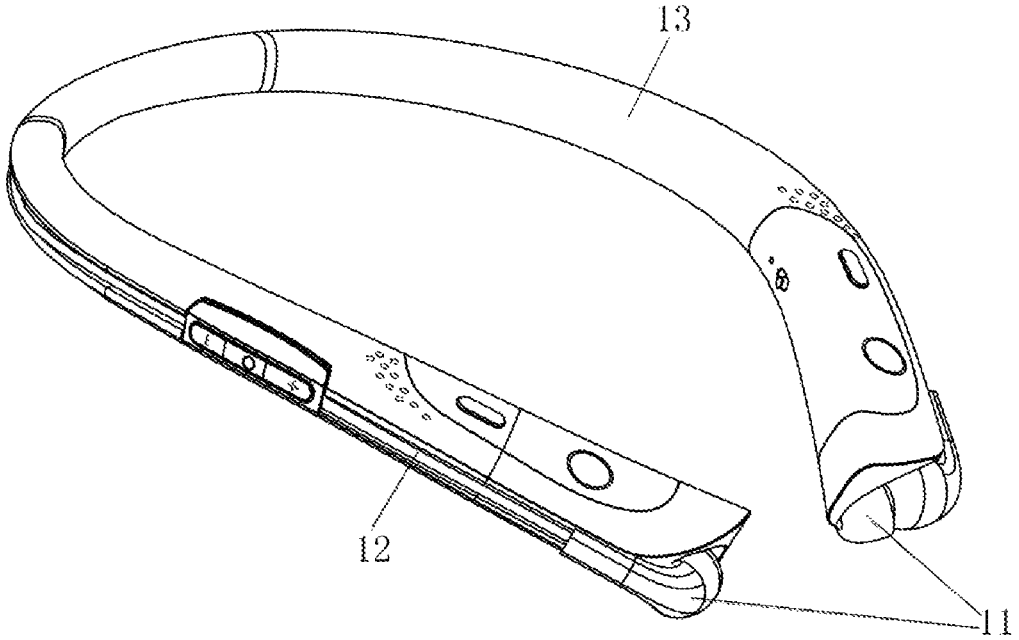
FIG. 2 shows a schematic structural view of the portable earphone device in a stored state according to one embodiment of the present disclosure.

FIG. 2 shows a schematic structural view of a portable earphone device in the stored state according to one embodiment of the present disclosure.

In this example, the neck band 13 is arc-shaped. A first accommodating groove 14 for accommodating the earphone body 11 is provided at each of both ends of the neckband 13. The neckband 13 is also provided with a second accommodating groove 15 for accommodating the wire 12. For example, the left earphone portion and the right earphone portion are respectively accommodated in the two first accommodating grooves 14, and the second accommodating groove 15 is provided along an outer side of the neckband 13. This arrangement can allow the neckline-type earphone to be completely embedded in the neckband 13, thereby making the appearance of the portable earphone device aesthetic.

In one example, the wire 12 is magnetically attracted in the second accommodating groove 15. For example, as shown in FIG. 1, a plurality of magnetic elements 17 are provided on the wire 12. A magnet for attracting the magnetic elements 17 is provided within the second accommodating groove 15. At the time of storage, the wire 12 is sucked into the second accommodating groove 15 by the attraction of the magnetic elements 17 and the magnet. This arrangement improves the adhesion between the wire 12 and the second accommodating groove 15, and effectively prevents the wire 12 from disengaging from the neckband 13.

In one example, the neckband 13 further comprises a power module for supplying power to the second wireless communication module, the network connection module and the processor. For example, the power module includes a lithium ion battery. The lithium ion battery supplies power to the above-mentioned three modules and charges the headphone body 11 through a power management circuit. The power supply of the earphone body 11 has a small capacity and can be charged by a power module on the accommodating device.

Optionally, the power module further comprises a USB interface or a Type-C interface for charging the power module.

In one example, the neckline-type earphone further comprises a wire controller 18 disposed on the wire 12. The neckband 13 is also provided with a third accommodating groove 16 for accommodating the wire controller 18. In this way, the wire controller 18 is embedded in the neckband 13.

Preferably, the wire controller 18 comprises a contact for charging the neckline-type earphone. A charging terminal 19 for electrically connecting to the contact is disposed within the third accommodating groove 16. In the stored state, the wire controller 18 is accommodated in the third accommodating groove 16, and the charging terminal 19 is electrically connected to the power module to charge the neckline-type earphone. In this way, the endurance time of the portable earphone device is effectively increased. In addition, while being charged, the portable earphone device can be used as a neckband-type earphone, such as for listening to music and the like.

For example, since the neckband 13 has a large expansion space, the battery capacity of the neckband 13 can be enlarged. The space of the earphone body 11 is small, so that a battery having a small capacity can be provided in the limited space. The portable earphone device is charged by being stored in the neckband 13 to ensure the endurance time. At the same time, a device for improving the sound quality of the earphone can be provided in the space saved.

In other examples, contacts are provided on the earphone body 11, and charging terminals 19 are provided within the first accommodating groove 14. Charging is performed when the left earphone portion and the right earphone portion are accommodated in the first accommodating grooves 14, as shown in FIG. 2.

In one example, as shown in FIG. 3, a sounding device is further provided on the neckband 13. The sounding device is communicationally connected to the processor. For example, two loudspeakers 20 are symmetrically disposed on the neckband 13. When in use, a music file or a voice stream read by the processor can be directly played as an external sound through the loudspeakers 20.

In one example, a storage device is further provided on the neckband 13, the storage device being communicationally connected to the processor. For example, a memory card is inserted in the neckband 13, the memory card being stored with music files. The user can send a voice command through the voice module on the neckline-type earphone and then transmit it to the processor through the Bluetooth module. The processor retrieves the music files in the memory card and directly plays the local storage.

Although some specific embodiments of the present disclosure have been described in detail with reference to examples, the skilled person in the art should understand that the above-mentioned examples are intended to be illustrative only and not to limit the scope of the present disclosure. It is understood in the art that the above embodiments may be modified without departing from the scope and spirit of the present disclosure. The scope of the present disclosure is defined by the attached claims.

What is claimed is:

1. A portable earphone device, comprising:

a neckline-type earphone, comprising a voice module and a first wireless communication module communicationally connected to the voice module; and a neckband, comprising a second wireless communication module, a network connection module, and a processor, both the second wireless communication module and the network connection module being communicationally connected to the processor, the first wireless communication module being communicationally connected to the second wireless communication module, and the neckline-type earphone being detachably accommodated in the neckband to constitute a neckband-type earphone, wherein the neckband is arc-shaped, a first accommodating groove for accommodating an earphone body is provided at each of both ends of the neckband, and the neckband is also provided with a second accommodating groove for accommodating a wire.

2. The portable earphone device as claimed in claim 1, wherein the neckband further comprises a power module for supplying power to the second wireless communication module, the network connection module and the processor.

3. The portable earphone device as claimed in claim 1, wherein the wire is magnetically attracted in the second accommodating groove.

4. The portable earphone device as claimed in claim 1, wherein it further comprises a wire controller disposed on the wire, the neckband being further provided with a third accommodating groove for accommodating the wire controller.

5. The portable earphone device as claimed in claim 4, wherein the wire controller comprises a contact for charging the neckline-type earphone, a charging terminal for electrically connecting to the contact being disposed within the third accommodating groove, the charging terminal being electrically connected to the power module.

6. The portable earphone device as claimed in claim 1, wherein a sounding device is further provided on the neckband, the sounding device being communicationally connected to the processor.

7. The portable earphone device as claimed in claim 1, wherein a storage device is further provided on the neckband, the storage device being communicationally connected to the processor.

8. The portable earphone device as claimed in claim 1, wherein the first wireless communication module and the second wireless communication module are a Bluetooth module or an infrared module.

9. The portable earphone device as claimed in claim 1, wherein the network connection module is a WIFI module, a 2G communication module, a 3G communication module, a 4G communication module or a 5G communication module.

* * * * *